US006543555B2

(12) United States Patent
Casagrande

(10) Patent No.: US 6,543,555 B2
(45) Date of Patent: Apr. 8, 2003

(54) AUTOMATIC LOADER FOR DRILL RODS

(75) Inventor: Mauro Casagrande, Sacile (IT)

(73) Assignee: Casagrande SpA, Fontanafredda (IT)

( * ) Notice: Subject to any disclaimer, the term of this patent is extended or adjusted under 35 U.S.C. 154(b) by 25 days.

(21) Appl. No.: 09/797,636

(22) Filed: Mar. 2, 2001

(65) Prior Publication Data

US 2001/0020550 A1 Sep. 13, 2001

(30) Foreign Application Priority Data

Mar. 8, 2000 (IT) ..... UD00A0049

(51) Int. Cl.[7] ..... E21B 19/20; E21B 19/00

(52) U.S. Cl. ..... 175/85; 175/52; 414/22.66; 414/22.51

(58) Field of Search ..... 175/52, 85; 414/22.51, 414/22.63, 22.62, 22.66, 745.2; 294/902

(56) References Cited

U.S. PATENT DOCUMENTS

| | | | | |
|---|---|---|---|---|
| 3,336,991 A | | 8/1967 | Klem et al. | |
| 3,828,943 A | * | 8/1974 | Simon | 175/85 |
| 3,883,009 A | | 5/1975 | Swboda, Jr. et al. | |
| 3,985,189 A | * | 10/1976 | Jahnke et al. | 173/164 |
| 4,445,579 A | * | 5/1984 | Bello | 175/52 |
| 4,449,592 A | * | 5/1984 | Mayer | 173/164 |
| 4,892,160 A | | 1/1990 | Schivley, Jr. et al. | |
| 5,174,389 A | | 12/1992 | Hansen | |
| 5,653,297 A | * | 8/1997 | Whisenhunt | 173/164 |
| 5,762,150 A | | 6/1998 | Cheng et al. | |
| 6,220,807 B1 | * | 4/2001 | Sorokan | 166/77.52 |

FOREIGN PATENT DOCUMENTS

| | | | | |
|---|---|---|---|---|
| DE | 1 483 865 B1 | | 10/1966 | |
| EP | 0 424 733 A1 | | 5/1991 | |
| EP | 0 860 581 A1 | | 8/1998 | |
| GB | 2083106 A | * | 3/1982 | E21B/19/14 |
| JP | 4-269295 | * | 9/1992 | E21B/19/20 |
| WO | WO 84/01599 A1 | | 4/1984 | |
| WO | WO 94/24410 A1 | | 10/1994 | |

* cited by examiner

*Primary Examiner*—David Bagnell
*Assistant Examiner*—Daniel P Stephenson
(74) *Attorney, Agent, or Firm*—Akin, Gump, Strauss, Hauer & Feld, L.L.P.

(57) ABSTRACT

An automatic loader (10) for drill rods (11) adapted to be associated with a boring machine having a guide and drive assembly (12) for the drill rods (11) includes at least a store (13) containing a plurality of drill rods (11) and a movement assembly (14) that is able to selectively remove, one at a time, the drill rods (11) from the store (13) to position them on the guide and drive assembly (12). The movement assembly (14) is arranged in an intermediate position between the store (13) and the guide and drive assembly (12), so as to not interfere with the latter during the removal of the drill rods (11) from the store (13).

28 Claims, 5 Drawing Sheets

AUTOMATIC LOADER FOR DRILL RODS

FIELD OF THE INVENTION

This invention concerns an automatic loader for drill rods employed in association with boring machines comprising a guide and drive assembly, on which the drill rods are mounted and made to rotate in order to drill the ground.

The automatic loader according to the invention comprises a store, on which a plurality of drill rods are temporarily arranged, located adjacent to the guide and drive assembly of the boring machine.

A pick-up mechanism, cooperating with the store, is provided to selectively pick up one of the rods and position it on the guide and drive assembly.

BACKGROUND OF THE INVENTION

Conventional boring machines, employed to bore the ground, comprise a guide and drive assembly able to make the drill rods rotate; the drill rods are several meters long and at the lower end a drilling tool is associated to drill the ground.

In order to perform drilling operations of several tens of meters in depth, it is necessary to attach a plurality of drill rods one after the other, until the specified depth is reached.

The drill rods are normally prepared in appropriate containers, or stores, arranged at the side of the boring machine; they are mounted onto the guide and drive assembly one by one, by means of movement means, which are at least partly automatic.

The movement means, however, often do not ensure a secure grip of the drill rods during the pick-up step, and make it difficult to position the drill rods precisely on the guide and drive assembly.

The state of the art includes a boring machine wherein the loader is of the rotary type and is mounted on the frame, on one side with respect to the guide and drive assembly, while the movement means are mounted on the opposite side.

In this embodiment, however, the combination of the boring machine and the loader is very bulky.

With this machine, moreover, given the particular arrangement of the different assemblies, it is not possible to prepare a new drill rod while the boring machine is drilling, due to the interference which the movement means would create with the guide and drive assembly.

Therefore, the time required to load the drill rods is substantially lengthened, which does not make possible to optimize the working cycle of the boring machine.

The present Applicant has devised and embodied this invention to overcome these shortcomings and to obtain other advantages.

SUMMARY OF THE INVENTION

The invention is set forth and characterized in the main claim, while the dependent claims describe other characteristics of the main embodiment.

The purpose of the invention is to achieve a loader which will allow to perform the operations of arranging the drill rods on the guide and drive assembly easily, quickly and completely automatically, limiting to a minimum the inactive times of the boring machine with which it is associated. Another purpose of the invention is to achieve a loader for drill rods which is extremely versatile, that is, which can be used for drill rods of different lengths and diameters, and which has a limited bulk so that the relative boring machine can be used even in limited operating spaces.

The automatic loader according to the invention is associated on one side of the guide and drive assembly of the relative boring machine and comprises at least a store to contain the drill rods and a movement device arranged in an intermediate position between the store and the guide and drive assembly.

To be more exact, the movement device comprises at least an oscillating arm associated at the end with a gripper member which can be selectively activated by actuator means of a pneumatic or oil-dynamic type.

The gripper member is also able to rotate with respect to the relative oscillating arm, to cooperate selectively with the rod container store and with the guide and drive assembly.

In a preferential embodiment, the gripper member comprises jaws of an interchangeable type, which can be replaced according to the diameter of the drill rods which have to be moved.

In an advantageous embodiment, the container store is also of the rotary type, so that it can be selectively arranged with the drill rod to be used facing towards the movement device.

According to the invention, the drill rods are picked up from the container store and arranged in an operating position on the guide and drive assembly by a coordinated movement of the oscillating arm and the gripper member.

Thanks to the position of the movement device, it is possible to pick up and prepare the drill rods for loading even while the boring machine is drilling, since there is no danger of interference between the movement device and the guide and drive assembly.

As soon as the drilling step is finished, the new rod to be loaded can thus be mounted immediately onto the guide and drive assembly, so that the inactive time of the boring machine is reduced to a minimum.

During the movement of the container store to the guide and drive assembly, the drill rods are always gripped by the gripper member, which substantially prevents any risk of the drill rods falling.

The automatic loader according to the invention is also extremely compact and suitable to act in very limited spaces, therefore the boring machine with which it is associated can be used substantially under any operating conditions.

BRIEF DESCRIPTION OF THE DRAWINGS

These and other characteristics of the invention will be clear from the following description of some preferred forms of embodiment, given as a non-restrictive example, with reference to the attached drawings wherein.

DETAILED DESCRIPTION OF PREFERRED EMBODIMENTS

Figure 1:
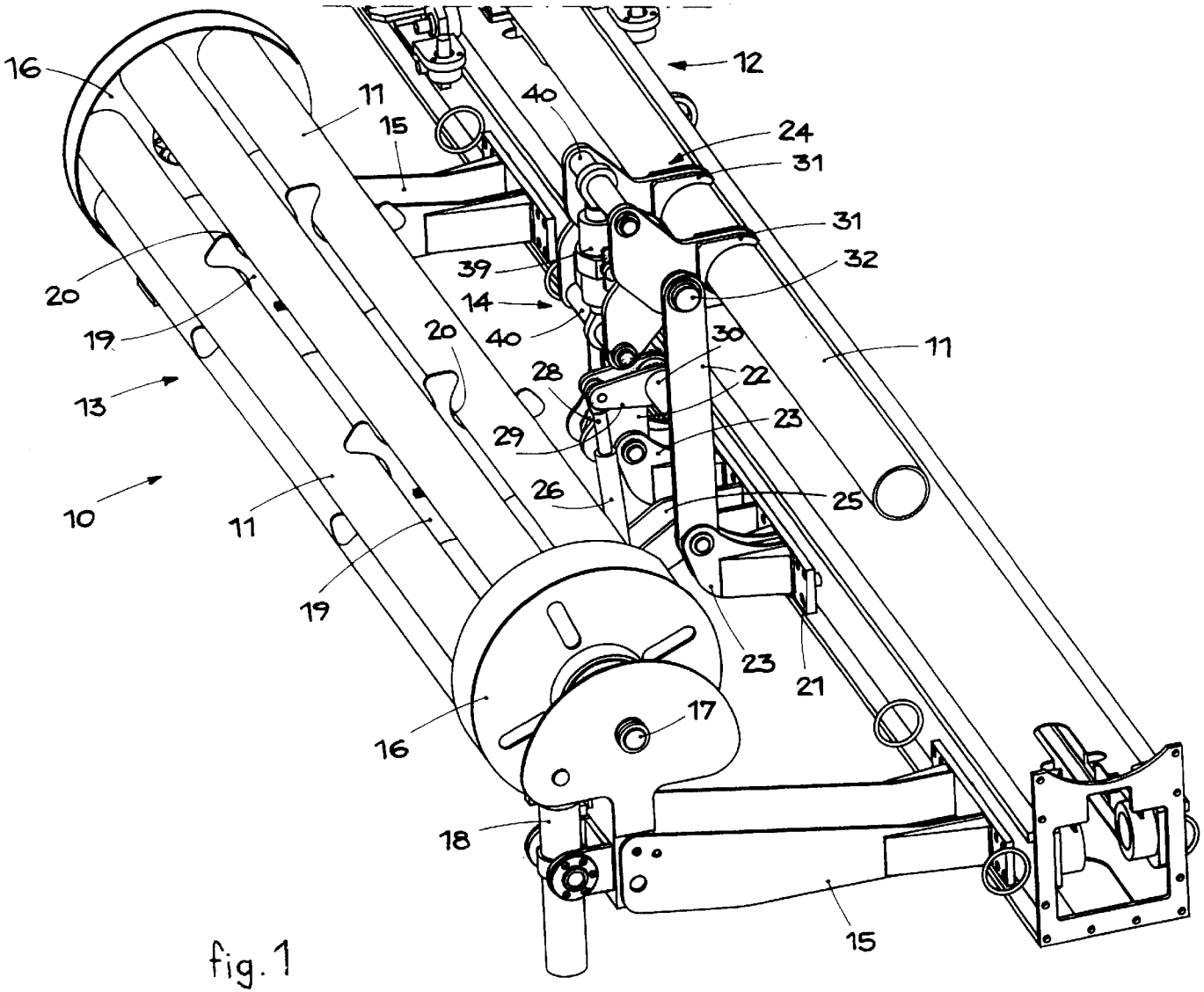
FIG. 1 is a three-dimensional view of the automatic loader for drill rods according to the invention.

With reference to the attached drawings, an automatic loader 10 for drill rods 11 is laterally associated with a guide and drive assembly 12 of a boring machine.

The automatic loader 10 comprises a store 13 to contain the drill rods 11 and a movement device 14 able to pick up each drill rod 11 individually from the store 13 to position it on the guide and drive assembly 12 by means of which it is subsequently made to rotate in order to drill the ground.

The store 13 is solidly associated with the guide and drive assembly 12 by means of two brackets 15, shown only in FIG. 1 for reasons of greater clarity, and comprises two disks 16, parallel to each other, able to contain the drill rods 11 above and below.

The disks 16 are mounted on a shaft 17 able to be made to rotate selectively by means of an appropriate drive member 18, for example consisting of a ratchet gear device commanded by a hydraulic cylinder or by a motion reducer of a conventional type.

On the shaft 17, in an intermediate position between the disks 16 and parallel thereto, there are also two circular racks 19 provided on the perimeter with a plurality of hollows 20 arranged radially and able to keep the drill rods 11 positioned.

In a preferential embodiment, the two disks 16 can be positioned at a variable distance to adapt to the length of the different drill rods 11, while the circular racks 19 are interchangeable according to the diameter of the rods 11.

According to a variant, diameter reduction elements, not shown in the drawings, are able to be mounted, interposed between the circular racks 19 and the rods 11, in correspondence with the hollows 20.

With this solution it is not necessary to replace the circular racks 19 when the diameter of the drill rods 11 varies.

According to another variant, the circular racks 19 are provided, in correspondence with the hollows 20, with retaining elements, not shown in the drawings, which can be selectively activated to keep the drill rods 11 in position.

The movement device 14 is also attached, by means of a relative profile 21, to the guide and drive assembly 12, in an intermediate position between the latter and the store 13.

Figure 2:
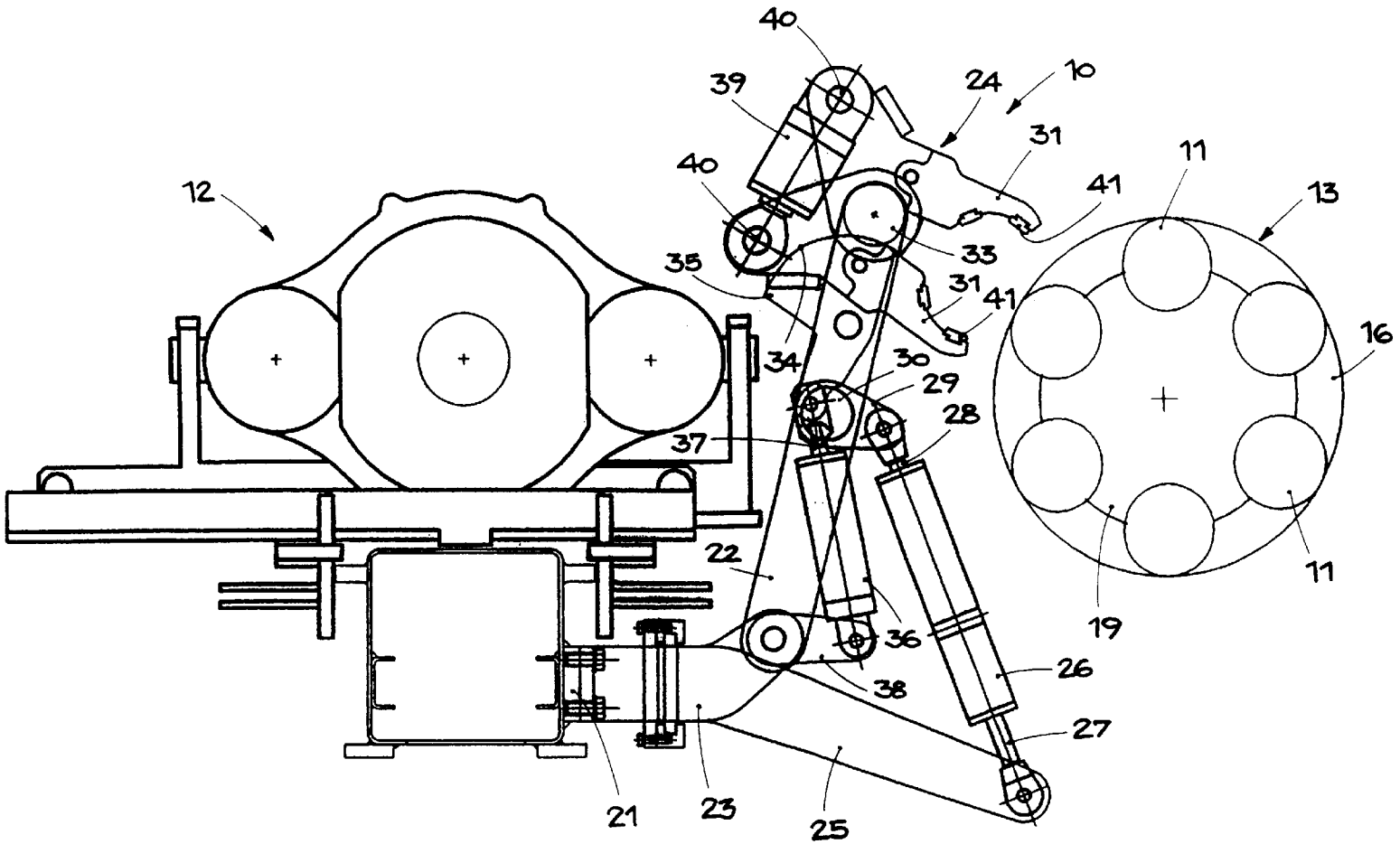
FIGS. 2, 3 and 4 are schematic views from above of the automatic loader according to the invention in three different working steps.
Figure 3:
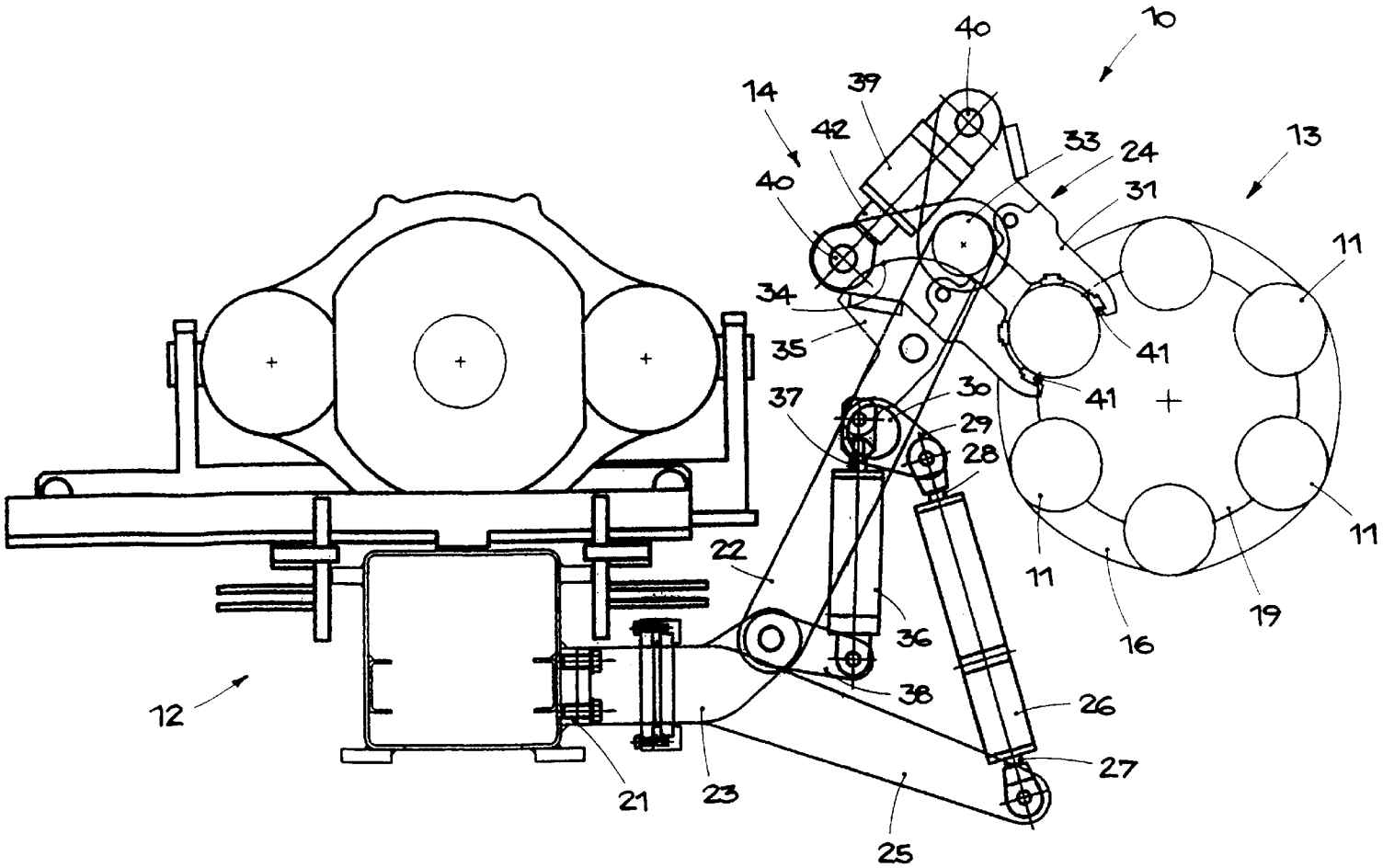
Figure 4:
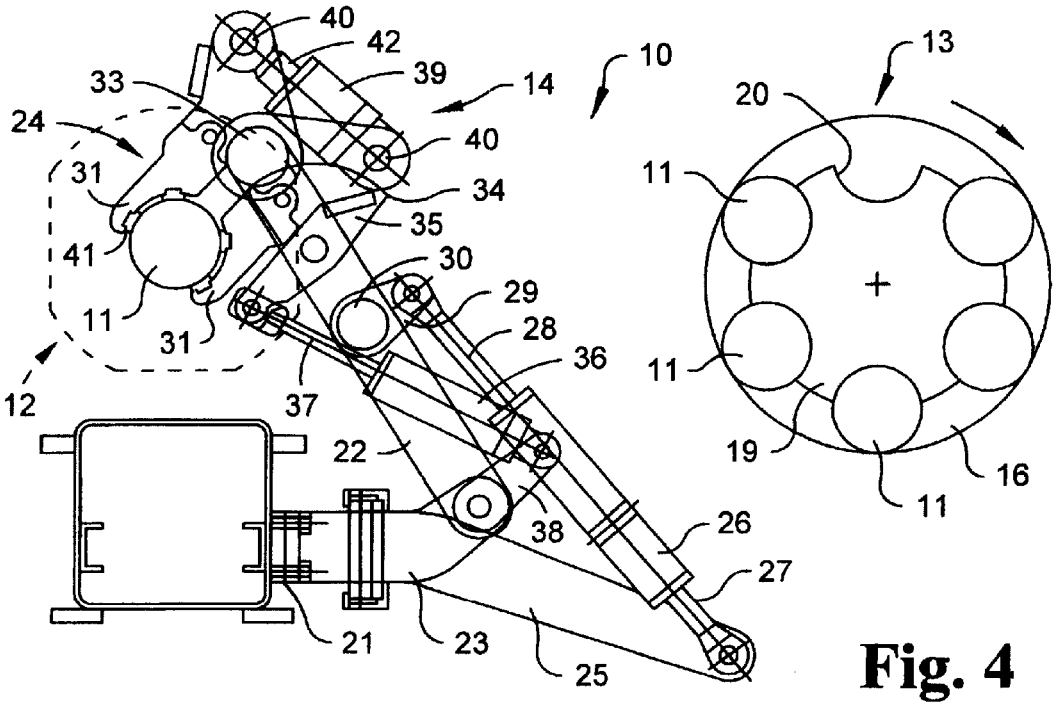
Figure 5:
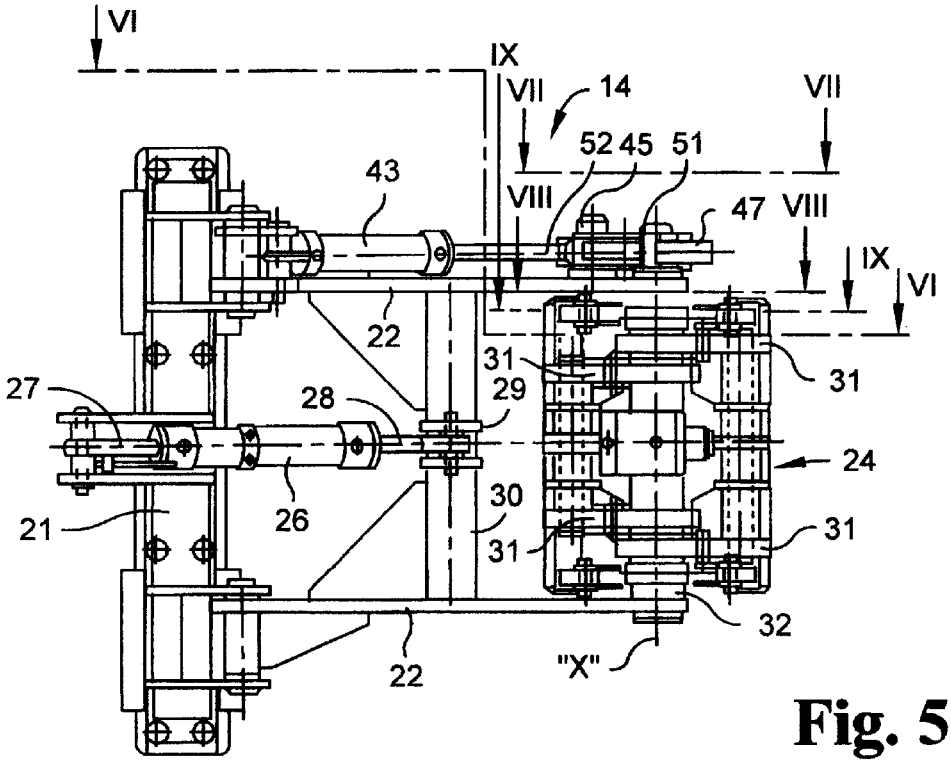
FIG. 5 is a side view of a variant of the movement device of the automatic loader according to the invention.

The movement device 14 comprises two oscillating arms 22, of which only one can be seen in FIGS. 2–4, transverse with respect to the longitudinal axis of the guide and drive assembly 12; the oscillating arms 22 are pivoted on respective supports 23 attached to the profile 21 in correspondence with one end, and associated with a gripper member 24 at the other end.

A stationary arm 25 is also associated with the profile 21 at an intermediate position between the two supports 23; a first rod 27 of a double actuator 26 is constrained rotatably to the free end of said stationary arm 25.

The second rod 28 of the double actuator 26 is pivoted on a collar 29 solidly associated with a cross-piece 30 which connects the two oscillating arms 22.

By activating the double actuator 26, the oscillating arms 22 are therefore able to be moved from a first position in proximity with the store 13 (FIG. 3) to a second position cooperating with the guide and drive assembly 12 (FIG. 4).

The gripper member 24 is constrained to the oscillating arms 22 by means of a pin 32 around the axis of which it is able to rotate selectively from a position facing the store 13 (FIGS. 2 and 3) to a position facing the guide and drive assembly 12 (FIGS. 1 and 4).

To be more exact, in the embodiment shown in FIGS. 2–4, a pinion 33 is keyed onto the pin 32 and a circular toothed sector 34, made on a shaped plate 35 pivoted on one of the oscillating arms 22, is engaged on the pinion 33.

The rod 37 of an actuator 36 pivoted on a connection element 38 associated with said oscillating arm 22 is rotatably constrained to the shaped plate 35.

Activating the actuator 36 causes the shaped plate 35 to rotate and therefore also the circular toothed sector 34 which, being engaged on the pinion 33, transmits the rotation to the gripper member 24.

In the embodiment shown here, the gripper member 24 comprises two pairs of jaws 31, of which a single pair is visible in FIGS. 2–4, mounted on the pin 32.

The jaws 31 of the gripper member 24 are connected in twos by a pair of transverse pins 40 with which an actuator 39 is associated in correspondence with the ends.

Activating the actuator 39 causes the two pairs of jaws 31 to rotate simultaneously with respect to the pin 32 and thus causes the gripper member 24 to open or close.

In this case, moreover, each jaw 31 has a pair of anti-slip inserts 41 able to improve the gripping conditions of the gripper member 24 on the drill rods 11.

With reference to FIGS. 2–4, we shall now describe how the automatic loader 10 according to the invention works.

The movement device 14, initially in the inactive position with the gripper member 24 open (FIG. 2), is brought near the store 13 by making the oscillating arms 22 rotate by retracting the rod 27 of the double actuator 26.

In this position the gripper member 24 is in correspondence with a drill rod 11 and is closed by extending the rod 42 of the actuator 39, causing the drill rod 11 to be gripped by the jaws 31 (FIG. 3).

Subsequently the rod 37 of the actuator 36 is extended to cause the shaped plate 35 to rotate and then, due to the effect of the coupling of the circular toothed sector 34 and the pinion 33, it causes the gripper member 24 to rotate which directs the drill rod 11 towards the guide and drive assembly 12.

By means of extending the two rods 27 and 28 of the double actuator 26, the oscillating arms 22 are then made to rotate, arranging the drill rod 11 in the relative seating on the guide and drive assembly 12 (FIG. 4).

At the same time, the shaft 17 of the store 13 is made to rotate by the member 18 to arrange a new drill rod 11 in a position accessible for the movement device 14.

By means of retracting the rod 42 of the actuator 39, the drill rod 11 arranged on the guide and drive assembly 12 is then released and the movement device 14 is moved towards the store 13 to allow drilling operations to start and at the same time to pick up the new drill rod 11.

When the new drill rod 11 has been picked up, the movement device 14 moves substantially to the position shown in FIG. 2, but with the gripper member 24 facing towards the guide and drive assembly 12 waiting for the first drilling step to be completed.

In this way, when at the end of the drilling step the guide and drive assembly 12 is free, the new drill rod 11 is quickly positioned simply by rotating the oscillating arms 22.

The cycle to load the drill rods 11 then restarts in the manner described until the specified drilling depth is reached.

FIGS. 5–9 show a different embodiment of the movement device 14.

This movement device 14 is provided with a different system to rotate the gripper member 24 which comprises an actuator 43 constrained at one end to the connection element 38 (FIG. 6) and at the other end to a lever assembly 50 (FIG. 7) associated with the gripper member 24.

To be more exact, the actuator 43 is connected at an intermediate point of a first lever 44 of said assembly 50, which pivots on a pin 45 mounted on one of the oscillating arms 22.

The first lever 44 is connected by means of a pin 46 to a second lever 47.

Figure 7:
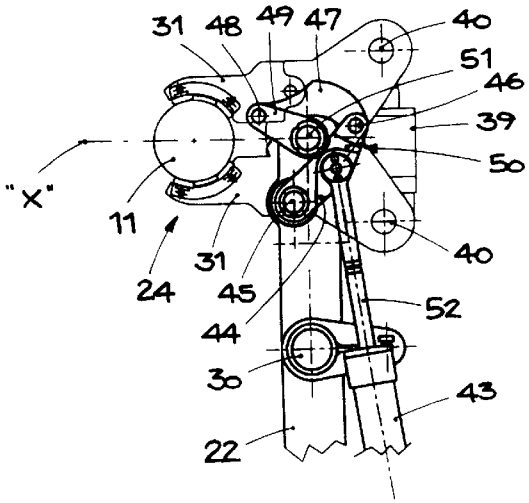
FIG. 7 is a partial side elevational view of the movement device as seen from line VII—VII of FIG. 5.

The second lever 47 is connected to a jaw 31 by means of a pin 48 with which a third lever 49 is also associated, pivoting on a pin 51 coaxial with the pin 32 (FIG. 7).

When the rod 52 of the actuator 43 is in its extracted condition, the gripper member 24 is facing towards the left, that is, towards the guide and drive assembly 12 (visible in FIGS. 2–4).

Activating the actuator 43 in the opposite direction, with the rod 52 retracted, causes the coordinated rotation in a clock-wise direction of the first lever 44 with respect to the pin 45, the second lever 47 with respect to the pin 46 and the third lever 49 with respect to the pin 51.

Accordingly, by means of the pin 48, the whole gripper member 24 is made to rotate with respect to the pin 32 to be turned toward the store 13, that is, towards the right in FIG. 7.

Figure 9:
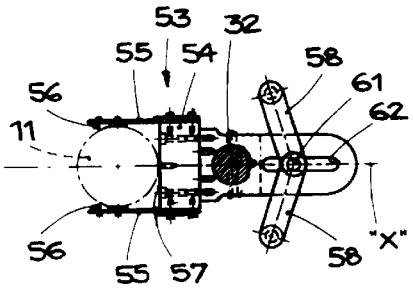
FIG. 9 is a sectional view of the movement device taken along line IX—IX of FIG. 5.
Figure 8:
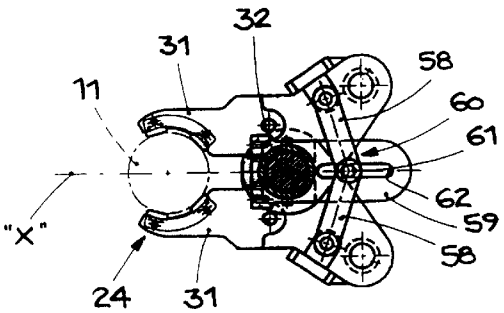
FIG. 8 is a sectional view of the movement device taken along line VIII—VIII of FIG. 5.
Figure 6:
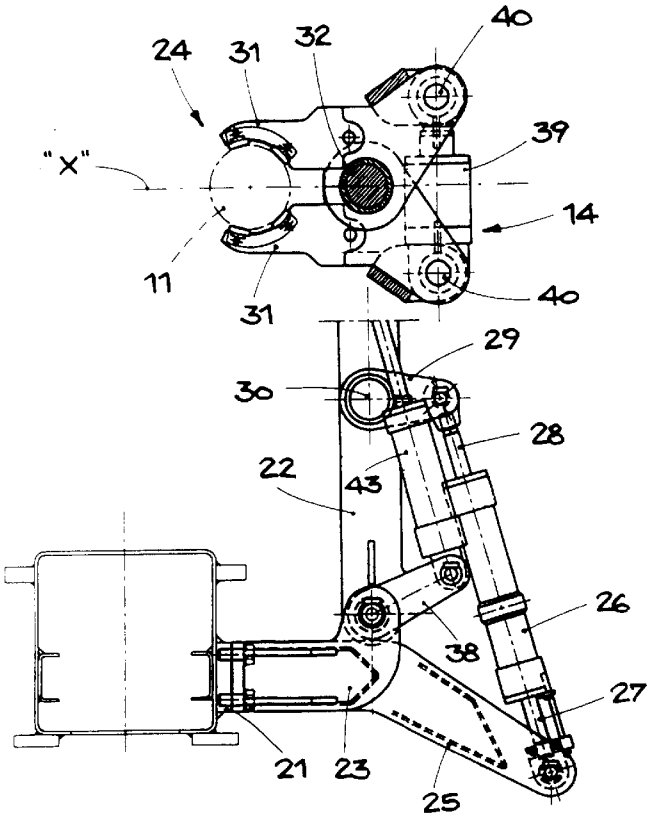
FIG. 6 is a part sectional view of the movement device taken along line VI—VI of FIG. 5.

The movement device 14 also comprises, in a position adjacent to the two pairs of jaws 31, two relative alignment and centering assemblies 53, keyed onto the pin 32 (FIG. 9).

Each alignment and centering assembly 53 comprises a supporting plate 54 provided at the front part with an abutment shoulder 57; at the sides of said plate 54 two elastic bars 55 are attached cantilevered.

The elastic bars 55 are arranged symmetrical with respect to the median longitudinal plane "X" of the gripper member 24 and are orthogonal with respect to the abutment shoulder 57.

The elastic bars 55 are also provided with pads 56 at the end, advantageously made of anti-wear and anti-friction material, able to cooperate with the outer surface of the drill rods 11 together with the abutment profile 57.

The alignment and centering assemblies 53 encourage the correct positioning of the gripper member 24 when the drill rod 11 is picked up.

To be more exact, when the gripper member 24, with its jaws 31 open, approaches the drill rod 11 to be picked up, the elastic bars 55 move to the sides of the rod 11, opening slightly to allow the latter to be positioned between them.

Subsequently, the approaching gripper member 24 causes the abutment shoulder 57 to rest on the rod 11; in this condition the rod 11 is closed between the elastic bars 55 in the centered position with respect to the median longitudinal plane "X" of the gripper member 24.

The alignment and centering assemblies 53 are particularly advantageous also when the gripper member 24 has to release the drill rod 11 into the appropriate seating of the guide and drive assembly 12.

During this step, in fact, when the jaws 31 are opened, the elastic bars 55 keep the rod 11 in an aligned position and at the same time, due to the presence of the pads 56, allow the rod 11 to slide axially to be positioned on the guide and drive assembly 12.

In the movement device 14 shown in FIGS. 5–9, moreover, each pair of jaws 31 is associated with a balancing mechanism 60 (FIG. 8) which makes possible for them to open and close symmetrically with respect to the median longitudinal plane "X" and therefore substantially with respect to the alignment and centering assembly 53 and the drill rod 11 to be picked up.

The balancing mechanism 60 comprises a pair of levers 58, each one pivoted on a relative jaw 31 and connected to a common central pin 61.

The central pin 61 can slide in an eyelet 62 arranged on the median longitudinal plane "X" and made on a plate 59 keyed onto the pin 32 which rotates the gripper member 24.

During the opening-closing of the jaws 31, the levers 58 rotate, making the central pin 61 slide inside the eyelet 62; the movement of the central pin 61 causes a coordinated and symmetrical rotation of the levers 58 and therefore the jaws 31 are symmetrically arranged with respect to the median longitudinal plane "X" and the axis of the alignment and centering assembly 53.

In this way the rod 11 is clamped more securely by the gripper member 24, to compensate for any possible play between the two.

It is obvious however that modifications and/or additions can be made to the automatic loader 10 as described heretofore, but these shall remain within the field and scope of the invention.

For example, the movement device 14 can comprise a single oscillating arm 22 and/or a single pair of jaws 31, or the system to rotate the gripper member 24 may be of a different type.

Moreover, the store 13 can house a different number of drill rods 11, also of a different diameter.

Furthermore, one of the two disks 16 can be of the stationary type, as it is sufficient that only one of them be movable in order to vary the configuration of the store 13 according to the length of the drill rods 11.

It is also obvious that, although the invention has been described with reference to specific examples, a skilled person shall certainly be able to achieve many other equivalent forms of automatic loader for drill rods, all of which shall come within the field and scope of the invention.

I claim:

1. Device to automatically load drill rods (11) in a boring machine provided with a drive assembly (12), comprising at least a store (13) with a longitudinal axis that is substantially parallel to a longitudinal axis of the drive assembly (12), the store (13) being able to contain a plurality of said drill rods (11), and movement means (14) arranged in an intermediate position between said store (13) and said drive assembly (12) and able to selectively remove, one at a time, said drill rods (11) from said store (13) to position them on said drive assembly (12), wherein said movement means (14) comprise at least a pick-up arm (22), movable between a first working position associated with said store (13) and a second working position associated with said drive assembly (12), and gripper means (24) mounted on said pick-up arm (22), the device being characterized in that said pick-up arm (22) is disposed between the store (13) and the drive assembly (12) and is actuated by a first actuator (26, 27, 28) for movement between said first and second working positions, said gripper means (24) comprising at least pincers pivoted on said pick-up arm (22) and a second actuator (33, 34, 35, 36, 43) spaced from the first actuator for rotating the pincers with respect to the pick-up arm (22) independently of the first actuator between a first pick-up position wherein the pincers face towards said store (13), to cooperate with one of said drill rods (11), and a second release position wherein the pincers face towards said drive assembly (12).

2. Device as in claim 1, characterized in that said pick-up arm (22) comprises a first end pivoted on a fixed pin and a second end, opposite the first, on which said pincers (24) are pivoted, the first actuator (26, 27, 28) being provided to make said pick-up arm (22) oscillate between said first and second working positions.

3. Device as in claim 2, characterized in that said pincers (24) are pivoted on a pin (32) mounted on said second end of said pick-up arm (22), and that a toothed pinion (33) is solid with said pin (32) and engages with a corresponding toothed conductor element (34).

4. Device as in claim 1, characterized in that said pincers (24) are able to make a rotation of about 180° to move from said first pick-up position to said second release position.

5. Device as in claim 1, characterized in that said pincers (24) comprise at least a pair of jaws (31) movable between a closed position wherein they clamp said drill rods (11) and an open position wherein said drill rods (11) are released.

6. Device as in claim 5, characterized in that said gripper means (24) comprise two pairs of jaws (31) able to clamp each of said drill rods (11) in two different zones, longitudinally distanced.

7. Device as in claim 5, characterized in that said jaws (31) are associated with at least a third actuator (39) which is able to move said jaws (31) into said closed and open position.

8. Device as in claim 5, characterized in that said jaws (31) are pivotally connected together through a pin (32), a balancing mechanism (60) is associated with each pair of jaws (31) in such a fashion that said jaws (31) have a symmetrical movement with respect to a median longitudinal plane ("X") passing through an axis of the pin (32) and through an axis of the drill rod (11) to be gripped.

9. Device as in claim 8, characterized in that said balancing mechanism (60) comprises a pair of levers (58), each lever being pivoted on a relative jaw (31), said levers (58) being oscillatory with respect to a common central pin (61) able to move along guide means (62) arranged on said median longitudinal plane ("X").

10. Device as in claim 5, characterized in that said jaws (31) have a particular conformation according to a diameter of the drill rods (11) to be moved, said jaws (31) also being inter-changeable according to said diameter.

11. Device as in claim 5, characterized in that said jaws (31) are provided with anti-slip inserts (41) able to improve the grip of said drill rods (11).

12. Device as in claim 1, characterized in that oscillating means (44, 47, 49) commanded by at least the second actuator (43) are associated with said pincers (24) to make them selectively rotate with respect to said pick-up arm (22).

13. Device as in claim 1, characterized in that said movement means (14) comprise at least an alignment and centering assembly (53) which is able to allow the correct positioning of said gripper means (24) with respect to the drill rod (11) to be removed from said store (13) and to keep the drill rod (11), when removed, substantially parallel to said drive assembly (12) during the movement of said pick-up arm (22) between said first working position and said second working position.

14. Device as in claim 1, characterized in that said movement means (14) comprise a pair of parallel pick-up arms (22) and that said gripper means (24) comprise a pair of pincers, each one associated with one of said pick-up arms (22).

15. Device as in claim 14, characterized in that said pick-up arms (22) are driven by the first actuator (26) mounted on a stationary support (25) solidly associated with said drive assembly (12).

16. Device as in claim 15, characterized in that said first actuator (26) comprises two facing rods (27, 28).

17. Device as in claim 1, characterized in that said store (13) is of the rotary type and comprises circular racks (19) rotating on a central shaft (17) and provided with peripheral hollows (20) on which said drill rods (11) are arranged, said peripheral hollows (20) being distributed at an angle in a substantially constant fashion along the whole periphery of said circular racks (19).

18. Device as in claim 1, characterized in that said store (13) comprises a plurality of specific seatings (20) for said drill rods (11) and is movable selectively to arrange each of said drill rods (11) in a position accessible to said movement means (14).

19. Device as in claim 18, characterized in that said seatings (20) are arranged circular and in that said store (13) is able to rotate to arrange each of said drill rods (11) in a position accessible to said movement means (14).

20. Device as in claim 18, characterized in that said seatings (20) are made on rack elements (19) interchangeable according to the diameter of said drill rods (11).

21. Device as in claim 18, characterized in that said store (13) comprises at least a base element (16) with a plate or disk, able to contain said drill rods (11) underneath.

22. Device as in claim 18, characterized in that said store (13) comprises at least two spaced base elements (16) able to contain said drill rods (11) at the ends.

23. Device to automatically load drill rods (11) in a boring machine provided with a drive assembly (12), comprising at least a store (13) able to contain a plurality of said drill rods (11) and movement means (14) arranged in an intermediate position between said store (13) and said drive assembly (12) and able to selectively remove, one at a time, said drill rods (11) from said store (13) to position them on said drive assembly (12), wherein said movement means (14) comprise at least a pick-up arm (22), movable between a first working position associated with said store (13) and a second working position associated with said drive assembly (12), and gripper means (24) mounted on said pick-up arm (22), the device being characterized in that said pick-up arm (22) in its movement between said first and second working positions remains constantly outside the bulk of said store (13) and in that said gripper means (24) comprise at least pincers pivoted on said pick-up arm (22) and able to rotate between a first pick-up position wherein they face towards said store (13), to cooperate with one of said drill rods (11), and a second release position wherein they face towards said drive assembly (12), said pick-up arm (22) comprising a first end pivoted on a fixed pin and a second end, opposite the first, on which said pincers (24) are pivoted, actuation means being provided to make said pick-up arm (22) oscillate between said first and second working positions, said pincers being pivoted on a pin (32) mounted on said second end of said pick-up arm (22), with a toothed pinion (33) that is solid with said pin (32) and engages with a corresponding toothed conductor element (34), said toothed conductor element (34) comprising a toothed sector pivoted on said pick-up arm (22) and able to be selectively actuated by a first actuator (36).

24. Device to automatically load drill rods (11) in a boring machine provided with a drive assembly (12), comprising at least a store (13) able to contain a plurality of said drill rods (11) and movement means (14) arranged in an intermediate position between said store (13) and said drive assembly (12) and able to selectively remove, one at a time, said drill rods (11) from said store (13) to position them on said drive assembly (12), wherein said movement means (14) comprise at least a pick-up arm (22), movable between a first working position associated with said store (13) and a second working position associated with said drive assembly (12), and gripper means (24) mounted on said pick-up arm (22), the device being characterized in that said pick-up arm (22) in its movement between said first and second working positions remains constantly outside the bulk of said store (13) and in that said gripper means (24) comprise at least pincers pivoted on said pick-up arm (22) and able to rotate between a first pick-up position wherein they face towards said store (13), to cooperate with one of said drill rods (11), and a second release position wherein they face towards said drive assembly (12), said pincers (24) comprising at least a pair of jaws (31) movable between a closed position wherein they clamp said drill rods (11) and an open position wherein said drill rods (11) are released, a balancing mechanism (60) being associated with each pair of jaws (31) in such a fashion that said jaws (31) have a symmetrical movement with respect to a median longitudinal plane ("X") passing through an axis of a pin (32) operably associated with said pincers (24) and through an axis of the drill rod (11) to be gripped, and an alignment and centering assembly (53) comprising at least two elastic containing extensions (55) mounted on opposite sides and symmetrical with respect to said median longitudinal plane ("X") and able to cooperate with the cylindrical surface of said drill rods (11).

25. Device as in claim 24, characterized in that said alignment and centering assembly (53) comprises an abutment element (57) arranged orthogonal with respect to said elastic extensions (55) and able to cooperate resting on the cylindrical surface of said drill rods (11).

26. Device as in claim 24, characterized in that said elastic extensions (55) are provided with sliding elements (56) able to allow the axial movement of said drill rods (11).

27. Device as in claim 26, characterized in that said sliding elements (56) are made of anti-friction and anti-wear material.

28. Device to automatically load drill rods (11) in a boring machine provided with a drive assembly (12), comprising at least a store (13) able to contain a plurality of said drill rods (11) and movement means (14) arranged in an intermediate position between said store (13) and said drive assembly (12) and able to selectively remove, one at a time, said drill rods (11) from said store (13) to position them on said drive assembly (12), wherein said movement means (14) comprise at least a pick-up arm (22), movable between a first working position associated with said store (13) and a second working position associated with said drive assembly (12), and gripper means (24) mounted on said pick-up arm (22), the device being characterized in that said pick-up arm (22) in its movement between said first and second working positions remains constantly outside the bulk of said store (13) and in that said gripper means (24) comprise at least pincers pivoted on said pick-up arm (22) and able to rotate between a first pick-up position wherein they face towards said store (13), to cooperate with one of said drill rods (11), and a second release position wherein they face towards said drive assembly (12), said store (13) comprising at least a base element (16) with a plate or disk, able to contain said drill rods (11) underneath, said store being substantially cylindrical in shape and rotatably mounted around a central shaft (17), at least one of said base elements (16) being movable longitudinally with respect to said shaft (17) to adapt its position according to the length of said drill rods (11).

* * * * *